US008678527B2

(12) United States Patent
Healy et al.

(10) Patent No.: US 8,678,527 B2
(45) Date of Patent: Mar. 25, 2014

(54) COMBINED TOOL CARRIER AND WORK TABLE

(75) Inventors: Michael A. Healy, Sheridan, WY (US); Connie L. Healy, Sheridan, WY (US)

(73) Assignee: The Pack Horse LLC, Sheridan, WY (US)

( * ) Notice: Subject to any disclaimer, the term of this patent is extended or adjusted under 35 U.S.C. 154(b) by 76 days.

(21) Appl. No.: 13/393,334

(22) PCT Filed: Apr. 26, 2011

(86) PCT No.: PCT/US2011/033867

§ 371 (c)(1), (2), (4) Date: Feb. 29, 2012

(87) PCT Pub. No.: WO2011/139661

PCT Pub. Date: Nov. 10, 2011

(65) Prior Publication Data

US 2012/0152155 A1 Jun. 21, 2012

Related U.S. Application Data

(60) Provisional application No. 61/327,860, filed on Apr. 26, 2010.

(51) Int. Cl.
*A47B 88/00* (2006.01)

(52) U.S. Cl.
USPC ..... 312/327

(58) Field of Classification Search
USPC ..... 312/281, 287, 324, 326–329, 100; 16/35 R; 248/213.2, 298.1, 189.11, 248/200; 108/134, 135
See application file for complete search history.

(56) References Cited

U.S. PATENT DOCUMENTS

| | | | | | |
|---|---|---|---|---|---|
| 1,900,760 | A | * | 3/1933 | Pendleton | 108/134 |
| 2,058,205 | A | * | 10/1936 | Bandura | 188/2 R |
| 2,920,920 | A | * | 1/1960 | Couse et al. | 296/26.02 |
| 3,118,685 | A | | 1/1964 | Jordan | |
| 3,262,714 | A | | 7/1966 | Langone | |

(Continued)

FOREIGN PATENT DOCUMENTS

| | | | |
|---|---|---|---|
| EP | 0787643 | A1 | 8/1997 |
| KR | 10-0408096 | B1 | 12/2003 |
| KR | 10-0459019 | B1 | 12/2004 |

OTHER PUBLICATIONS

Gull Wing Portable Power Distribution Systems GW Series, Dec. 14, 2008 http://web.archive.org/web/20081214145143/http://www.gull-wing.com/gwseries.html.

(Continued)

*Primary Examiner* — Matthew Ing
(74) *Attorney, Agent, or Firm* — Mark Nowotarski

(57) ABSTRACT

A combined tool carrier and work table comprised gull-wing covers. The gull-wing covers are dimensioned such that when the tool carrier is closed and the gull-wing covers are down, the height of the tool carrier is low enough so that it will fit underneath a tool bench with a waist high surface. When the tool carrier is moved to a remote job site and the gull-wing covers are opened, their sides become work surfaces elevated to about waist high, similar to the work bench. The gull-wing covers can then be locked into place to provide a secure work table.

17 Claims, 7 Drawing Sheets

(56) References Cited

U.S. PATENT DOCUMENTS

| | | | | |
|---|---|---|---|---|
| 3,445,150 | A * | 5/1969 | Zartarian | 312/249.8 |
| 3,544,183 | A | 12/1970 | Dixon | |
| D252,197 | S | 6/1979 | Gale | |
| 4,369,822 | A | 1/1983 | Rice | |
| 4,436,353 | A | 3/1984 | Tucker | |
| 4,466,628 | A | 8/1984 | Zerver | |
| 4,478,397 | A | 10/1984 | Krueger | |
| 5,183,372 | A | 2/1993 | Dinverno | |
| 5,224,531 | A | 7/1993 | Blohm | |
| 5,282,519 | A | 2/1994 | Venturo | |
| 5,452,908 | A | 9/1995 | Bencic | |
| 5,617,962 | A * | 4/1997 | Chen | 211/206 |
| 5,642,898 | A | 7/1997 | Wise | |
| 5,725,037 | A | 3/1998 | Faulhaber | |
| 5,988,243 | A | 11/1999 | Ayala et al. | |
| 6,047,750 | A | 4/2000 | Jensen | |
| 6,053,587 | A | 4/2000 | Boerder | |
| 6,170,723 | B1 | 1/2001 | Howell | |
| 6,315,376 | B1 | 11/2001 | Wiseman | |
| 6,634,631 | B2 | 10/2003 | Hebert | |
| 6,854,314 | B2 | 2/2005 | Cleave | |
| 6,942,229 | B2 | 9/2005 | Brazell | |
| 6,948,539 | B1 | 9/2005 | Barker | |
| 6,969,130 | B2 * | 11/2005 | Newton et al. | 312/223.1 |
| D549,749 | S | 8/2007 | Francis et al. | |
| 7,306,245 | B1 | 12/2007 | Lowe | |
| 7,458,403 | B2 | 12/2008 | Radermacher | |
| 2004/0250901 | A1 | 12/2004 | Ursell et al. | |
| 2005/0280228 | A1 | 12/2005 | Fernandes | |
| 2006/0091698 | A1 | 5/2006 | Williams | |
| 2007/0034124 | A1 * | 2/2007 | Benson | 108/134 |
| 2008/0104890 | A1 | 5/2008 | Starheim | |

OTHER PUBLICATIONS

Gull Wing Power Distribution Systems, Dec. 20, 2008 http://web.archive.org/web/20081220203243/http://www.gull-wing.com/.

Port a Mate, HTC Products, Inc., 2006.

Notification of Transmittal of the International Search Report and the Written Opinion of the International Searching Authority, or the Declaration, PCT/US2011/033867, Feb. 8, 2012.

Millermatic 212 Owners Manual, Miller, OM-232 384C, 2008.

Intermetro Industries Corporation, Metro Side-Load Polymer Dish & Tray Carts SSD/DSD Series, Wilkes-Barre, PA, Apr. 2008.

* cited by examiner

COMBINED TOOL CARRIER AND WORK TABLE

CROSS REFERENCE TO RELATED APPLICATIONS

This application claims the benefit of U.S. provisional patent application "Combined Tool Carrier and Work Table", Ser. No. 61/327,860, filed Apr. 26, 2010. Said provisional patent application is incorporated herein in its entirety by reference.

TECHNICAL FIELD

The inventions disclosed herein are in the field of combined tool carriers and work tables.

BACKGROUND ART

Trades persons (e.g. carpenters), need to transport their tools from storage locations to remote work locations. They also need work tables at said remote locations.

FIG. 1 is a perspective view of a combined tool carrier 100 and work table 102 described in U.S. Pat. No. 6,053,587 (i.e. '587 patent). The original item numbers are two digits and will not be otherwise referred to herein. New three digit item numbers have been provided. The new item numbers will be referenced herein.

The tool carrier of the '587 patent is designed to be as tall 104 as the required work table height 106. This limits where the tool carrier can be stored when not in use. It cannot be stored, for example, underneath another work table that has the same height. A typical work table height might be waist high or about 90 cm.

There is a long felt need, therefore, for a combined tool carrier and work table that is about waist high when located at a job site but is significantly lower than waist high when not in use so that it can be stored underneath another work table.

DISCLOSURE OF INVENTION

The Disclosure of Invention is provided as a guide to understanding the invention(s) disclosed herein. It does not necessarily describe all of the embodiments or the most generic embodiments.

FIG. 2 is a perspective view that illustrates an embodiment of a combined tool carrier and work table 200 suitable for storage underneath a waist high surface 202. The combined tool carrier and work table comprises a tool carrier 204, two "gull-wing covers" 206, and wheels 208, 209. The materials of construction may be metal, plastic, wood, or other material of suitable strength and durability. A suitable height 212 for the carrier is 50 cm. A suitable width 214 is 40 cm. A suitable length 216 is 90 cm. The wheels are dimensioned such that the bottom of the carrier is a suitable height off of the floor 218. A suitable height off of the floor may be 20 cm.

The wheels may comprise a set of "fixed axle wheels" 208 and a set of "pivotable wheels" 209. The fixed axle wheels may be mounted on an axle that is wider than the carrier in order to provide lateral stability. A suitable width 219 for said axle is 70 cm. The width of the fixed wheels should be less than the width of a typical door opening, such as 70 cm, so that said carrier may fit through said door.

The pivotable wheels 209 may be located underneath the carrier in order to allow steering when the carrier is moved.

A suitable overall height 222 of the carrier is significantly less than the height 224 of said waist high surface. An exemplary suitable overall height is 70 cm when said waist high surface height is about 90 cm.

Each gull-wing cover comprises a work surface 232 and a standoff surface 234. The work surface and standoff surface are fixedly joined at about right angles. The gull-wing covers are pivotably joined to each other by a hinge 236. A suitable hinge is a piano hinge extending the length of the standoff surfaces. The piano hinge is joined to the carrier by having the central rod of said piano hinge pass through a hole 237 in a tab 238 mounted on the side 204 of the carrier.

The work surfaces or standoff surfaces may comprise one or more openings. The work surface, for example, might be made of expanded metal. The standoff surface may be an open frame. Similarly, the top of the carrier may be an open frame. This might be used on conjunction with standoff surfaces are solid, expanded metal or other construction that would not allow items to be removed from the carrier when the gull-wing covers are closed.

The hinged joining of the gull-wing covers allows them to serve as covers for the carrier when the carrier is used for transport or storage. Said joining also allows the gull-wing covers to serve as an elevated work surface when the carrier is moved to a job site and used as a work table.

FIG. 3 is a perspective view that illustrates how the combined tool carrier and work table of FIG. 2 can be reconfigured to provide a waist high work table when said carrier is located at a job site and opened up 300.

When a gull-wing cover 302 is opened, it rotates 304 about the hinge 306 until the work surface 308 is horizontal. The standoff surface 312 elevates the work surface to a suitable height 314 for a work table. Opening the gull-wing covers also provides access to the tool storage volume 316 of the tool carrier. Thus a trades person simultaneously has access to his or her tools and a work table at an appropriate height.

Wheel locks 318 may be provided to secure the position of the work table when it is in use.

Means can also be provided to secure the gull-wing covers in place to provide a stable horizontal work surface. Exemplary securing means are described below.

FIG. 4 is a perspective view of the tool carrier that illustrates that a single gull-wing cover 402 can be hyper-pivoted 404 to provide a large vertical surface 405 in combination with the other gull-wing cover 406. Angled carriers 408 may be provided to hold large sheets of construction material, such as plywood or dry wall 412. The angled carriers may be pivotably attached 414 to the ends of the gull-wing covers so that said carriers can be rotated out of the way when not in use. Locking mechanisms can also be provided to secure the angled carriers in either position.

FIGS. 5A, 5B and 5C are end views of a tool carrier that illustrate a hinge configuration that allows the gull-wing covers to serve as covers for the tool carrier during transport, vertical transport means for sheets of material at a job site, and a work surface for working on said sheets of material at said job site. The size of the hinge and thickness of material are exaggerated to illustrate their operation.

Referring to FIG. 5A, a hinge 502 joins each gull-wing cover 504 at the centerline of the carrier 506. A rod 508 extends through the center of the hinge and passes through holes in the tabs 512 mounted on the ends of the carrier. Both gull-wing covers are down. This is the configuration for storage of the tool carrier or moving the tool carrier to a job site.

Referring to FIG. 5B, the hinge configuration allows a gull-wing cover to be hyper-pivoted 514 to form a vertical carrying surface for a large sheet of material 518. The tab 512 keeps the gull-wing /hinge assembly securely located on top of the carrier. Angled carriers 520 support the vertical sheet of material.

Referring to FIG. 5C, both gull-wing covers may be pivoted 522 to form a horizontal work table with the sheet that is being carried still in place. This is a convenient way to get a large heavy sheet of material on top of a table. The gull-wing covers may be then be secured in position to provide a stable work surface. This is described more fully below.

MODES FOR CARRYING OUT INVENTION

The detailed description is meant to be exemplary and not limiting. All individual features of the inventions described herein may be used individually or combined with each other to provide the benefits described herein. For example, said gull-wing covers may simply sit on said tool carrier instead of being pivotally attached. Said gull-wing covers may then be removed and oriented such that said work surfaces are horizontal and said standoff surfaces rest on top of said tool carrier with appropriate locking and/or support mechanisms in place. Thus a waist high work table may be provided without the need for a pivot joint.

Figure 1:
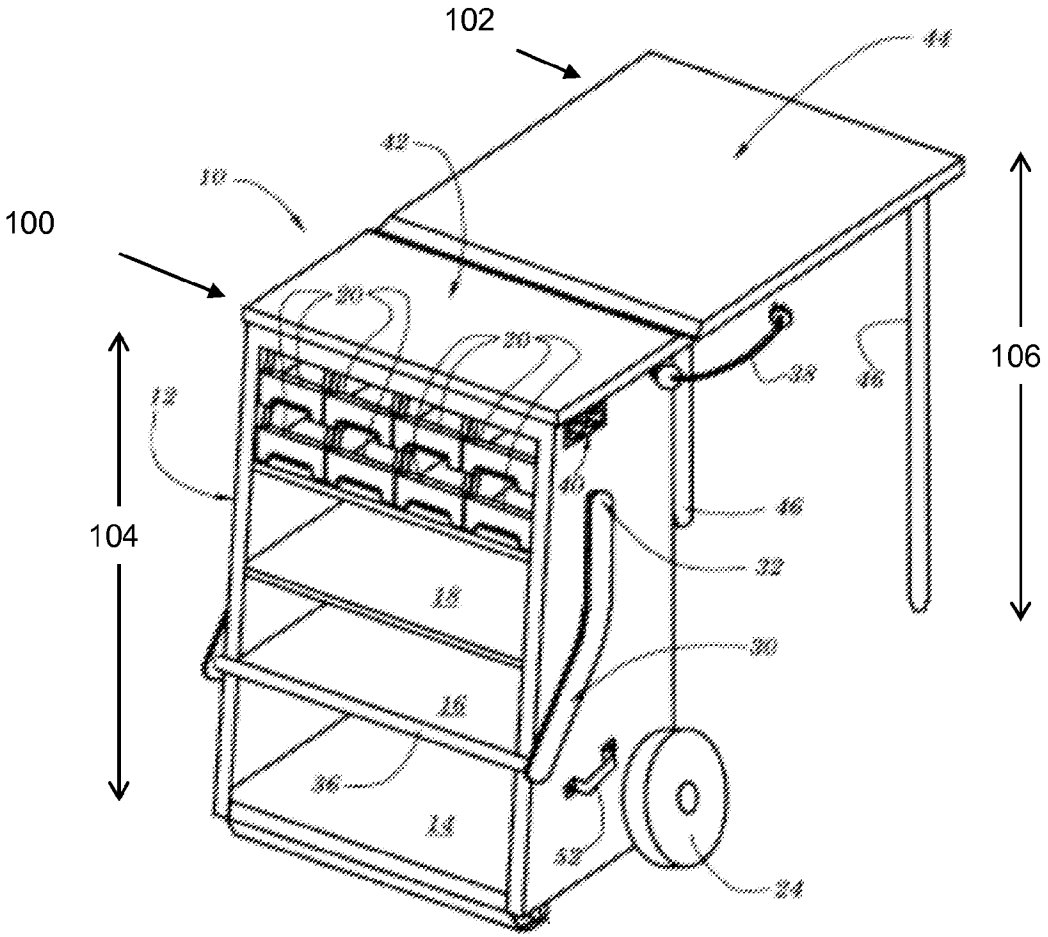
Fig. 1 (Prior Art)
FIG. 1 is a perspective view of a prior art combined tool carrier and work table.
Figure 2:
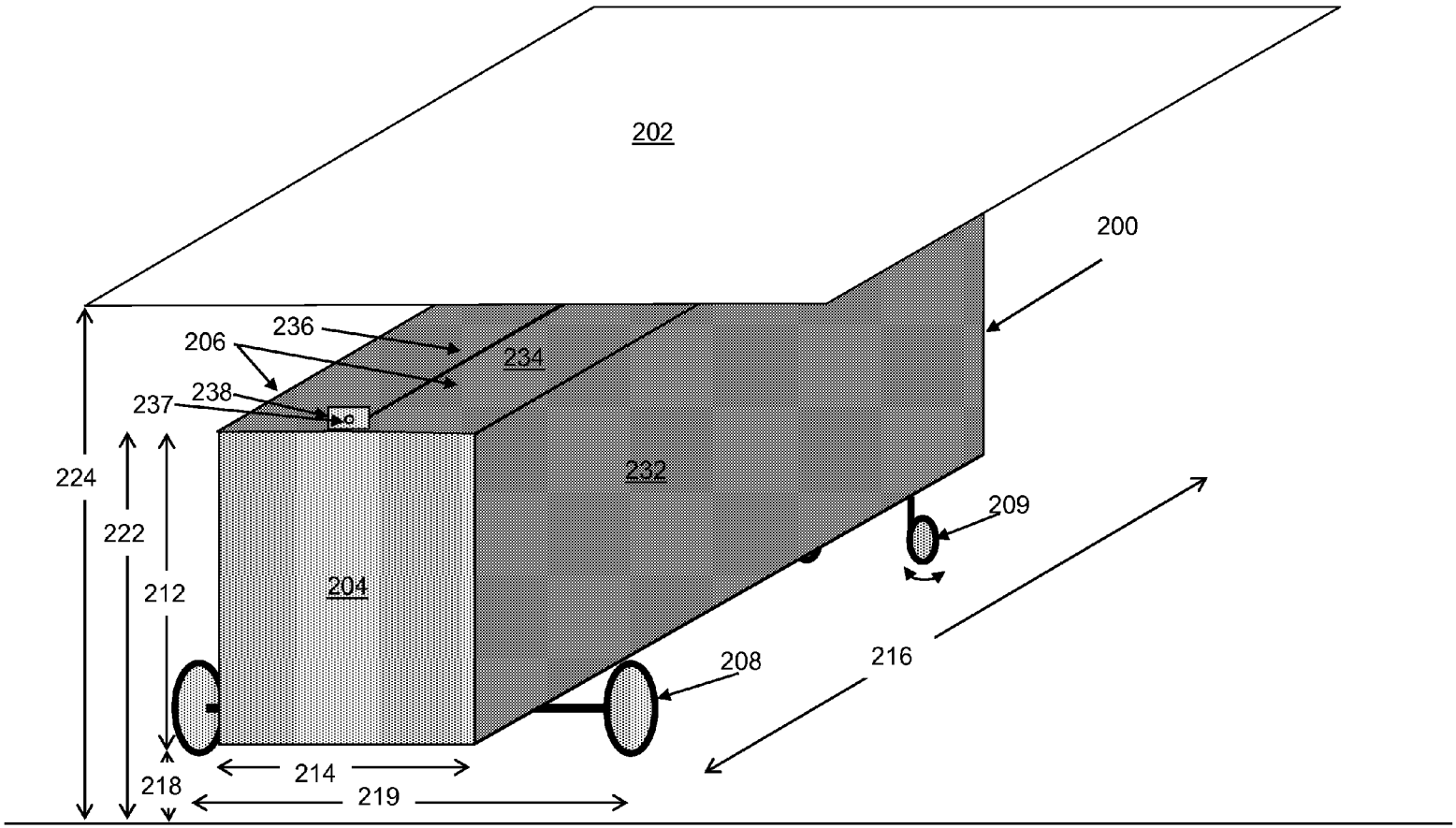
FIG. 2 is a perspective view of an exemplary combined tool carrier and work table that is closed up and stored under another work table.
Figure 3:
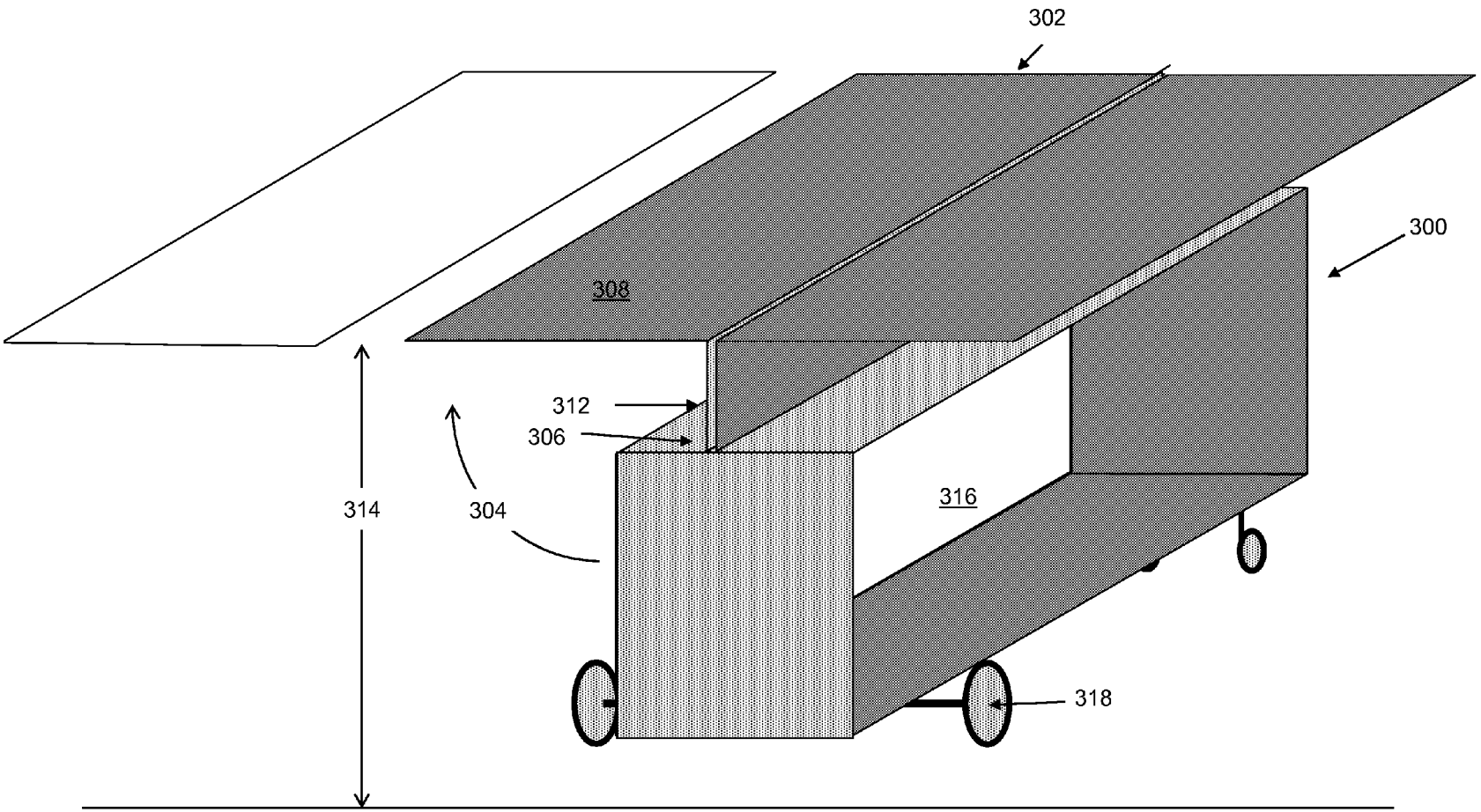
FIG. 3 is a perspective view of an exemplary combined tool carrier and work table that is opened up to provide a work table that is about waist high.
Figure 4:
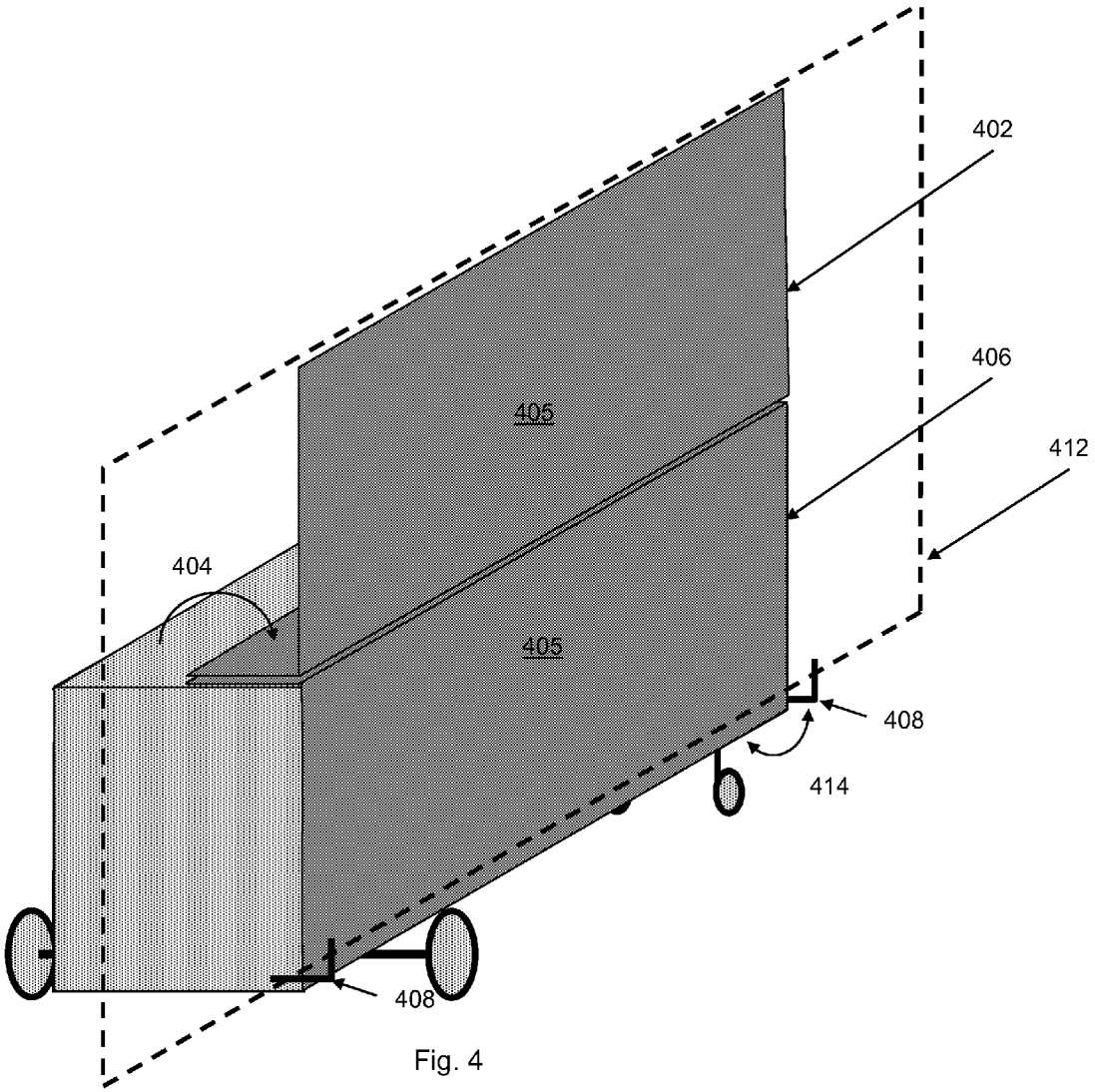
FIG. 4 is a perspective view of an exemplary combined tool carrier and work table that is configured to carry a large sheet of material.
Figures 5A, 5B, 5C:
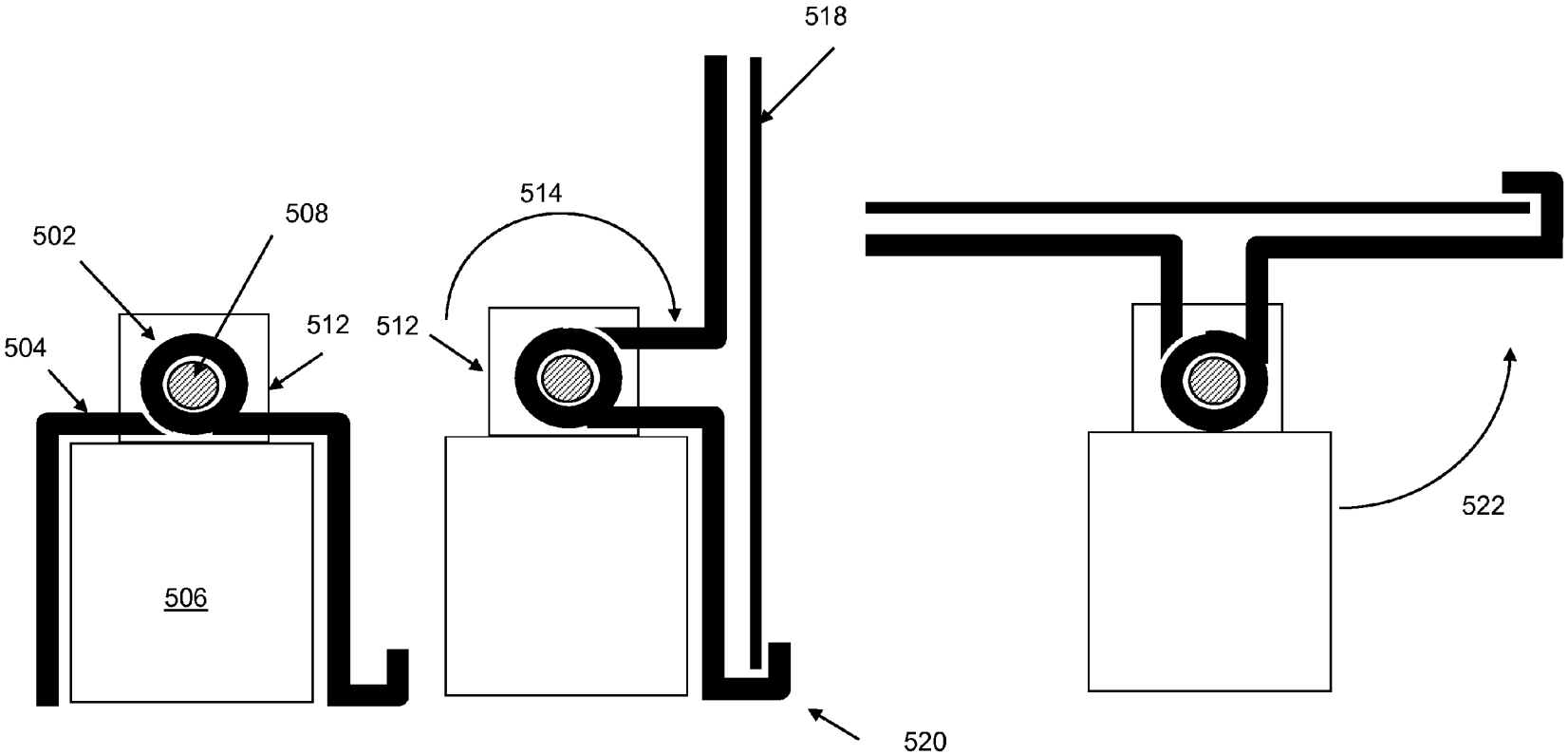
FIGS. 5A, 5B and 5C are end views showing how the tool carrier can be reconfigured from a "closed embodiment" to a "sheet carrier embodiment" and then to a "work table embodiment".
Figure 6:
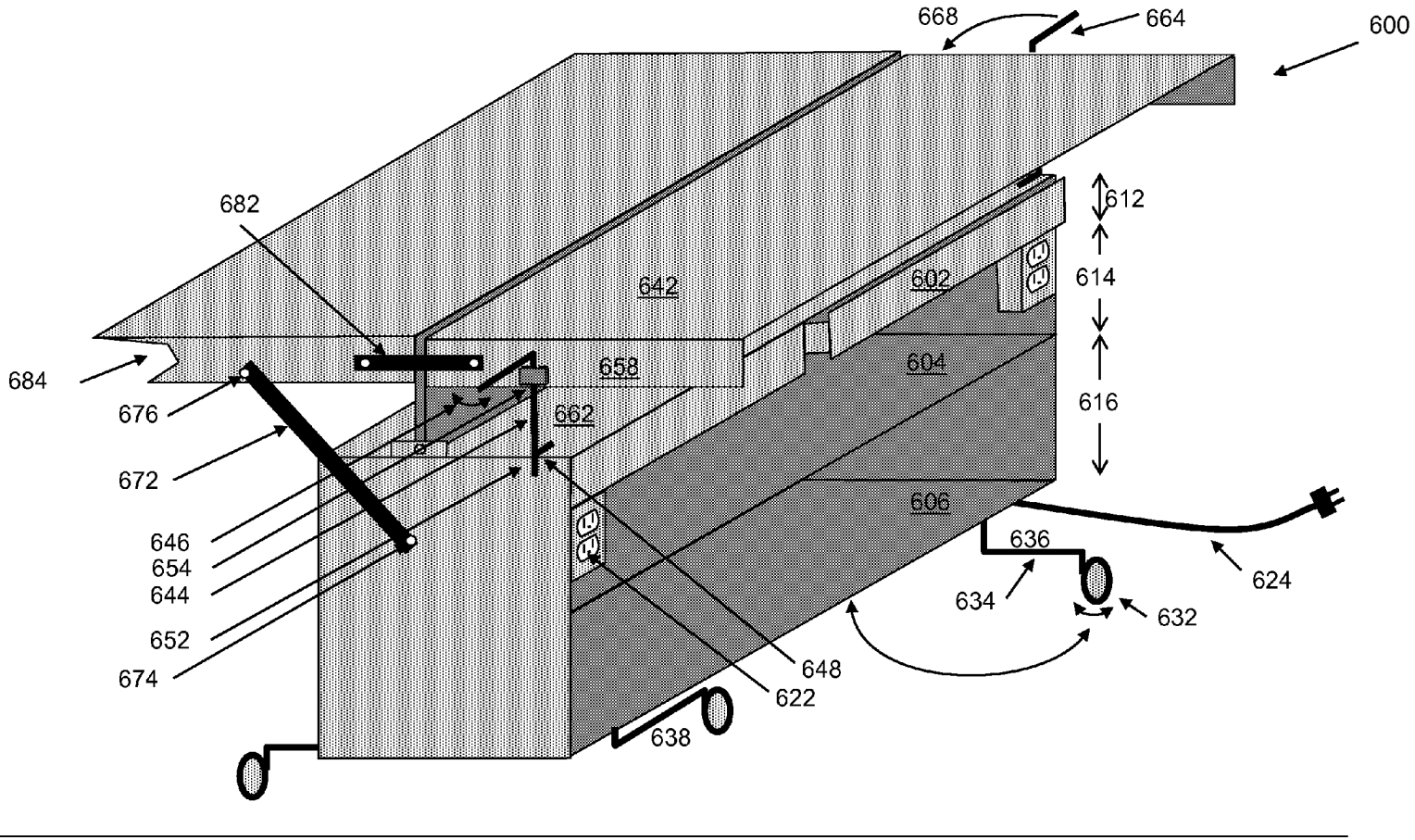
FIG. 6 is a perspective view of a work table embodiment.

FIG. 6 is a perspective view of the combined tool carrier and work table of FIG. 3 with additional useful features 600.

The tool storage volume can be subdivided into drawers 602 and shelves 604 and 606. As many drawers or shelves may be provided as is needed. A suitable height 612 for the drawers is 9 cm. A suitable clearance height for the first shelf 614 is 20 cm. A suitable clearance height for the bottom shelf 616 is 30 cm.

Multiple electrical outlets 622 can be provided. A suitable number of outlets is four. Two of each outlet can be provided at each end of the carrier. A single power supply cord 624 is suitable for providing power to all four outlets. Voltage and current ratings of the electrical system may be adjusted according to the intended use. Electrical safety features, such as a ground fault interrupter, may be provided.

The pivotable wheels 632 may be provided on pivotable cantilevers 634. The cantilevers are lockable in an outboard configuration 636 or inboard configuration 638. The outboard configuration serves to provide stability to the work table. The inboard configuration serves to minimize the foot print of the carrier when stored or moved. All four wheels may be both pivotable and cantilevered as shown.

A horizontal work surface 642 may be secured in a horizontal orientation by a pivotable vertical support bar 644. The vertical support bar may comprise a handle 646, horizontal support tab 648 and vertical guide tab 652. The vertical support bar may be pivotably joined 654 to a side support sheet 658. Thus in operation, a gull-wing cover is opened and the handle on the vertical support bar is rotated out so that the horizontal support tab rests on the top of the tool carrier 662 with the vertical guide tab helping to properly position it and provide lateral stability. Vertical support bars can be provided on each side 664 of each gull-wing cover.

When the tool carrier is to be closed, the handles on the vertical support bars are rotated against the side supports 668 so the horizontal support tabs clear the sides of the tool carrier and the gull-wing covers can rotate down.

An alternative means for supporting the work surface in a horizontal orientation comprises an angled support bar 672. That is pivotably and removably attached to the side of the tool carrier 674 and the side support sheet 676.

The two gull-wing covers may be held together with a clasp 682 when opened to the table configuration. This will add extra strength in the horizontal orientation and allow the work surfaces to move as a unit from the vertical orientation to the horizontal orientation.

Cutouts, such as a notch 684, may be provided in the side support sheets. This will allow said side support sheets to serve as carriers for long sections of construction material when the work surfaces are in their vertical orientation. An example of a long section of construction material is a US "two by four" piece of lumber.

Figure 7:
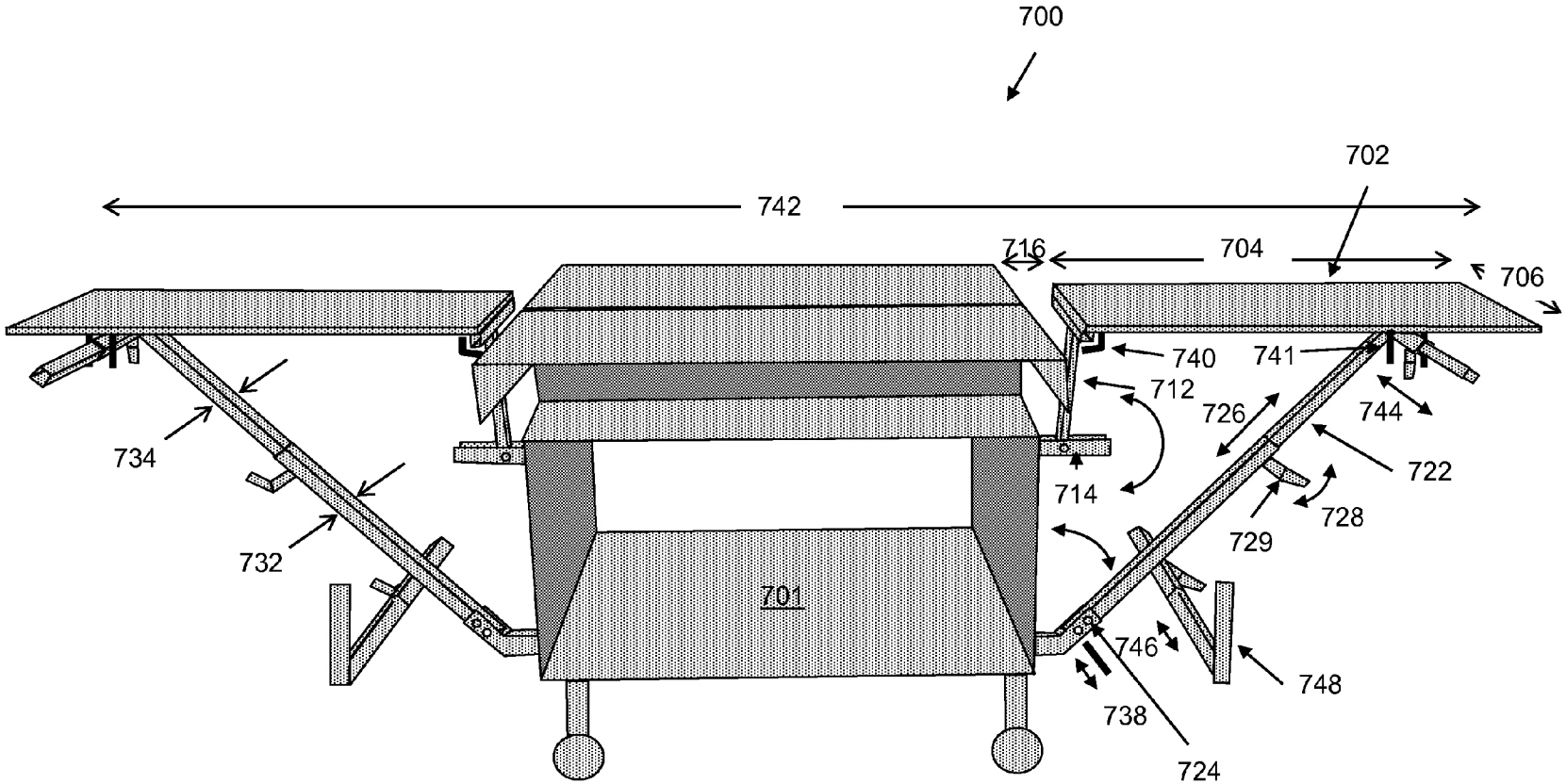
FIG. 7 is a perspective view of a work table embodiment that has additional "wing work surfaces".

FIG. 7 is a front perspective view of a combined tool carrier and work table with additional features 700.

Removable wing tables 702 can be provided to extend the surface of the work table. The wing tables may be 80 cm long (704) by 40 cm wide (706). Thus when said wing tables are removed, they can be stored in the tool carrier 701.

The wing tables are supported by an inboard "T bar" 712 and an outboard "T bar" 722. The inboard T bar is pivotably attached to the side of the tool carrier by pinch clamp 714. When the tool carrier is in storage or being transported, the inboard T bar is rotated down and is out of the way. When the tool carrier is opened up at a job site, the inboard T bar is rotated up and held in position by the pinch clamp.

The outboard T bar is pivotably attached to the lower portion of the side of the tool carrier by locking joint 724. When the tool carrier is in storage or being transported, the outboard T bar is rotated upward and held in place by pinch clamp 714. When the tool carrier is opened up, the outboard T bar is rotated down to a desired angle, such as 45 degrees. It is held securely in position at the desired angle by a removable locking pin 738 or other appropriate locking device.

The outboard T bar may be telescoping in length 726. This is achieved by nesting an inner square section within an outer square section. The outer square section can have a width (732) of 3 cm. The inner square section can have a width (734) of 2.5 cm. Other cross sections may be used, such as circular. The inner square section can be telescoped out to the proper position and held securely in place by a threaded locking bolt 728. The locking bolt has a handle 729 for ease of operation. Locking pins, tape, clamps or other suitable locking mechanisms may be used.

The wing table is held securely but removably to the T bars by pinch clamps 740, 741 which snap the wing table into position.

Either an inboard or an outboard T bar can also serve as a handle for pulling the tool carrier when the wing tables are not in place.

The outboard T bar can have a telescoping top cross member 744. This provides additional support for a large sheet of material that is placed on the table. Locking mechanisms such as those described above may also be provided.

The lower portion of the outboard T bar can comprise a telescoping material carrier 746. The material carrier comprises a vertical end bar 748. The material carrier may be set to extend past the side of the tool carrier. Thus the material carrier can hold long sections of material, such as 240-360 cm long sections of structural lumber.

When both wing tables are in place, the total width 742 of the work table can be 260 cm.

Alternative Embodiments

As presented herein, all dimensions are to be considered "about". "About" means plus or minus 10% of a given value.

The embodiments described herein are generally scaled for people with a waist height of about 90 cm. The inventions can be scaled, however, for people of any waist height. Short persons, including children capable of using a work bench, might have a waist height as low as 30 cm. Tall persons might have a waist height as high as 120 cm.

Other dimensions related to construction materials, such as table length, may be scaled according to standard construction materials dimensions in various localities. In the US, for example, a standard dimension for structural lumber is a "12 foot 2 by 4". A standard dimension for a sheet of material is a "4 by 8".

Other dimensions of the tool carrier, such as width of the axel for the fixed wheels, can be scaled according to standard construction dimensions in a given locality, such as standard door openings.

The choice of materials and strength of construction of the tool carrier can be adjusted according to the intended use. A heavy duty construction model might be constructed of metal plate. A model for crafts might be constructed of wood. A model of children's toys might be constructed of molded plastic.

Battery power and motorized wheels can be provided. This might be appropriate for construction sites where there is significant slope to the ground and extra power is needed to move the tool carrier up a hill.

We claim:

1. A combined tool carrier and work table which comprises a first gull-wing cover and a second gull-wing cover wherein:

a) each of said gull-wing covers comprises a work surface and a standoff surface fixedly joined at about right angles;

b) the height of said tool carrier is less than a waist height;

c) the width of said standoff surfaces plus the height of said tool carrier is about said waist height;

d) each of said work surfaces is about said waist height when said gull-wing covers are oriented such that said work surfaces are horizontal and said standoff surfaces at least rest on the top of said tool carrier; wherein means are provided to secure said gull-wing covers such that said work surfaces form a stable horizontal work surface.

2. The combined tool carrier of claim 1 wherein said waist height is in the range of about 30 cm to 120 cm.

3. The combined tool carrier of claim 1 wherein said waist height is about 90 cm.

4. The combined tool carrier of claim 1 which further comprises a hinge and wherein said hinge joins said first gull-wing cover and said second gull-wing cover to said tool carrier.

5. The combined tool carrier of claim 4 wherein said hinge is adapted to allow at least one of said gull-wing covers to hyper pivot such that said work surface of said first gull-wing cover and the work surface of said second gull-wing cover are aligned in about a vertical plane when said at least one of said gull-wing covers is hyper pivoted.

6. The combined tool carrier of claim 5 wherein at least one of said gull-wing covers comprises a means for holding a sheet of construction material when said work surfaces of said gull-wing covers are oriented to form a vertical plane.

7. The combined tool carrier of claim 6 wherein said means for holding a sheet of material comprises two angled carriers that are mounted on opposite ends of one of said gull-wing covers.

8. The combined tool carrier of claim 5 which further comprises a first tab and a second tab and wherein:

a) said tabs are each mounted on an end of said tool carrier and;

b) said hinge comprises a rod which extends through the center of said hinge and passes through holes in said tabs thus securing said hinge to said tool carrier.

9. The combined tool carrier of claim 1 which further comprises at least one pivotable wheel mounted on a pivotable cantilever such that said wheel may be moved between a position outboard of said tool carrier to a position underneath said tool carrier.

10. The combined tool carrier of claim 1 wherein said first gull-wing cover comprises side support sheets on each side of said first gull-wing cover and wherein a notch is provided in each of said side support sheets such that a long piece of structural wood will sit in said notches in a horizontal orientation when the work surface of said first gull-wing cover is in a vertical orientation.

11. The combined tool carrier of claim 10 wherein said notches are dimensioned to hold one or more US dimension construction lumber two by fours.

12. The combined tool carrier of claim 1 which further comprises a wing table, an inboard T bar and an outboard T bar wherein said T bars are configured to hold said wing table in a horizontal orientation in about the same plane as said work surfaces when said work surfaces are in a horizontal orientation.

13. The combined tool carrier of claim 12 wherein said outboard T bar comprises a telescoping material carrier wherein said telescoping material carrier is configured to provide a horizontal portion which a piece of construction material may rest on.

14. The combined tool carrier of claim 12 which comprises two wing tables and wherein the total width of said wing tables and the work surface of said first gull-wing table is about 260 cm.

15. The combined tool carrier of claim 1 wherein said waist height is about 30 cm and said tool carrier is composed at least in part of molded plastic.

16. The combined tool carrier of claim 1 wherein said standoff surface is an open frame.

17. The combined tool carrier of claim 1 wherein the top of said carrier is an open frame.

* * * * *